US009704472B2

(12) United States Patent
Kwatra

(10) Patent No.: US 9,704,472 B2
(45) **Date of Patent: *Jul. 11, 2017**

(54) SYSTEMS AND METHODS FOR SHARING SECONDARY PATH INFORMATION BETWEEN AUDIO CHANNELS IN AN ADAPTIVE NOISE CANCELLATION SYSTEM

(71) Applicant: Cirrus Logic, Inc., Austin, TX (US)

(72) Inventor: Nitin Kwatra, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 334 days.

This patent is subject to a terminal disclaimer.

(21) Appl. No.: 14/101,893

(22) Filed: Dec. 10, 2013

(65) Prior Publication Data

US 2015/0161981 A1 Jun. 11, 2015

(51) Int. Cl.

| | |
|---|---|
| ***G10K 11/178*** | (2006.01) |
| ***H04R 1/10*** | (2006.01) |
| ***H04R 25/00*** | (2006.01) |

(52) U.S. Cl.

CPC ..... *G10K 11/1784* (2013.01); *H04R 1/1083* (2013.01); *H04R 25/00* (2013.01); *G10K 2210/1081* (2013.01); *H04R 2460/01* (2013.01); *H04R 2460/15* (2013.01)

(58) Field of Classification Search

CPC ..... G10K 11/175; G10K 11/1786; G10K 2210/108; G10K 2210/1081; G10K 11/1784; H04R 1/1083; H04R 2460/01; H04R 2460/15; H04R 25/00

See application file for complete search history.

(56) References Cited

U.S. PATENT DOCUMENTS

| | | | |
|---|---|---|---|
| 5,117,401 | A | 5/1992 | Feintuch |
| 5,251,263 | A | 10/1993 | Andrea et al. |
| 5,272,656 | A | 12/1993 | Genereux |
| 5,278,913 | A | 1/1994 | Delfosse et al. |
| 5,321,759 | A | 6/1994 | Yuan |
| 5,337,365 | A | 8/1994 | Hamabe et al. |
| 5,359,662 | A | 10/1994 | Yuan et al. |
| 5,377,276 | A | 12/1994 | Terai et al. |
| 5,410,605 | A | 4/1995 | Sawada et al. |

(Continued)

FOREIGN PATENT DOCUMENTS

| | | | |
|---|---|---|---|
| DE | 102011013343 | A1 | 9/2012 |
| EP | 0412902 | A2 | 2/1991 |

(Continued)

OTHER PUBLICATIONS

International Patent Application No. PCT/US2014/049600, International Search Report and Written Opinion, Jan. 14, 2015, 12 pages.

(Continued)

*Primary Examiner* — Ping Lee

(74) *Attorney, Agent, or Firm* — Jackson Walker L.L.P.

(57) ABSTRACT

Systems and methods of the present disclosure include analyzing and comparing transfer functions associated with a plurality of electro-acoustic paths for transducers of a personal audio device to determine proximity of the transducers to respective ears of a listener of the personal audio device, quality of acoustic seals associated with the transducers, and for one or more other purposes.

23 Claims, 5 Drawing Sheets

(56) References Cited

U.S. PATENT DOCUMENTS 5,425,105 A 6/1995 Lo et al.
5,445,517 A 8/1995 Kondou et al.
5,465,413 A 11/1995 Enge et al.
5,481,615 A 1/1996 Eatwell et al.
5,548,681 A 8/1996 Gleaves et al.
5,559,893 A 9/1996 Krokstad
5,586,190 A 12/1996 Trantow et al.
5,640,450 A 6/1997 Watanabe
5,668,747 A 9/1997 Ohashi
5,696,831 A 12/1997 Inanaga
5,699,437 A 12/1997 Finn
5,706,344 A 1/1998 Finn
5,740,256 A 4/1998 Castello Da Costa et al.
5,768,124 A 6/1998 Stothers et al.
5,815,582 A 9/1998 Claybaugh et al.
5,832,095 A 11/1998 Daniels
5,909,498 A 6/1999 Smith
5,940,519 A 8/1999 Kuo
5,946,391 A 8/1999 Dragwidge et al.
5,991,418 A 11/1999 Kuo
6,041,126 A 3/2000 Terai et al.
6,118,878 A 9/2000 Jones
6,219,427 B1 4/2001 Kates et al.
6,278,786 B1 8/2001 McIntosh
6,282,176 B1 8/2001 Hemkumar
6,317,501 B1 11/2001 Matsuo
6,418,228 B1 7/2002 Terai et al.
6,434,246 B1 8/2002 Kates et al.
6,434,247 B1 8/2002 Kates et al.
6,522,746 B1 2/2003 Marchok et al.
6,683,960 B1 1/2004 Fujii et al.
6,766,292 B1 7/2004 Chandran et al.
6,768,795 B2 7/2004 Feltstrom et al.
6,850,617 B1 2/2005 Weigand
6,940,982 B1 9/2005 Watkins
7,058,463 B1 6/2006 Ruha et al.
7,103,188 B1 9/2006 Jones
7,181,030 B2 2/2007 Rasmussen et al.
7,330,739 B2 2/2008 Somayajula
7,365,669 B1 4/2008 Melanson
7,406,179 B2 7/2008 Ryan
7,466,838 B1 12/2008 Moseley
7,555,081 B2 6/2009 Keele, Jr.
7,680,456 B2 3/2010 Muhammad et al.
7,742,790 B2 6/2010 Konchitsky et al.
7,817,808 B2 10/2010 Konchitsky et al.
7,885,417 B2 2/2011 Christoph
8,019,050 B2 9/2011 Mactavish et al.
8,155,334 B2 4/2012 Joho et al.
8,249,262 B2 8/2012 Chua et al.
8,290,537 B2 10/2012 Lee et al.
8,325,934 B2 12/2012 Kuo
8,363,856 B2 1/2013 Lesso
8,374,358 B2 2/2013 Buck et al.
8,379,884 B2 2/2013 Horibe et al.
8,401,200 B2 3/2013 Tiscareno et al.
8,442,251 B2 5/2013 Jensen et al.
8,526,627 B2 9/2013 Asao et al.
8,539,012 B2 9/2013 Clark
8,804,974 B1 8/2014 Melanson
8,848,936 B2 9/2014 Kwatra et al.
8,907,829 B1 12/2014 Naderi
8,908,877 B2 12/2014 Abdollahzadeh Milani et al.
8,909,524 B2 12/2014 Stoltz et al.
8,942,976 B2 1/2015 Li et al.
8,948,407 B2 2/2015 Alderson et al.
8,948,410 B2 2/2015 Van Leest
8,958,571 B2 2/2015 Kwatra et al.
8,977,545 B2 3/2015 Zeng et al.
9,020,160 B2 4/2015 Gauger, Jr.
9,066,176 B2 6/2015 Hendrix et al.
9,082,391 B2 7/2015 Yermeche et al.
9,094,744 B1 7/2015 Lu et al.
9,106,989 B2 8/2015 Li et al.
9,107,010 B2 8/2015 Abdollahzadeh Milani et al.
9,203,366 B2 12/2015 Eastty
9,264,808 B2 2/2016 Zhou et al.
9,294,836 B2 3/2016 Zhou et al.
2001/0053228 A1 12/2001 Jones
2002/0003887 A1 1/2002 Zhang et al.
2003/0063759 A1 4/2003 Brennan et al.
2003/0072439 A1 4/2003 Gupta
2003/0185403 A1 10/2003 Sibbald
2004/0001450 A1 1/2004 He et al.
2004/0047464 A1 3/2004 Yu et al.
2004/0120535 A1 6/2004 Woods
2004/0165736 A1 8/2004 Hetherington et al.
2004/0167777 A1 8/2004 Hetherington et al.
2004/0176955 A1 9/2004 Farinelli, Jr.
2004/0196992 A1 10/2004 Ryan
2004/0202333 A1 10/2004 Czermak et al.
2004/0240677 A1 12/2004 Onishi et al.
2004/0242160 A1 12/2004 Ichikawa et al.
2004/0264706 A1 12/2004 Ray et al.
2005/0004796 A1 1/2005 Trump et al.
2005/0018862 A1 1/2005 Fisher
2005/0117754 A1 6/2005 Sakawaki
2005/0207585 A1 9/2005 Christoph
2005/0240401 A1 10/2005 Ebenezer
2006/0018460 A1 1/2006 McCree
2006/0035593 A1 2/2006 Leeds
2006/0055910 A1 3/2006 Lee
2006/0069556 A1 3/2006 Nadjar et al.
2006/0153400 A1 7/2006 Fujita et al.
2007/0030989 A1 2/2007 Kates
2007/0033029 A1 2/2007 Sakawaki
2007/0038441 A1 2/2007 Inoue et al.
2007/0047742 A1 3/2007 Taenzer et al.
2007/0053524 A1 3/2007 Haulick et al.
2007/0076896 A1 4/2007 Hosaka et al.
2007/0154031 A1 7/2007 Avendano et al.
2007/0258597 A1 11/2007 Rasmussen et al.
2007/0297620 A1 12/2007 Choy
2008/0019548 A1 1/2008 Avendano
2008/0101589 A1 5/2008 Horowitz et al.
2008/0107281 A1 5/2008 Togami et al.
2008/0144853 A1 6/2008 Sommerfeldt et al.
2008/0166002 A1 7/2008 Amsel
2008/0177532 A1 7/2008 Greiss et al.
2008/0181422 A1 7/2008 Christoph
2008/0226098 A1 9/2008 Haulick et al.
2008/0240413 A1 10/2008 Mohammad et al.
2008/0240455 A1 10/2008 Inoue et al.
2008/0240457 A1 10/2008 Inoue et al.
2009/0012783 A1 1/2009 Klein
2009/0034748 A1 2/2009 Sibbald
2009/0041260 A1 2/2009 Jorgensen et al.
2009/0046867 A1 2/2009 Clemow
2009/0060222 A1 3/2009 Jeong et al.
2009/0080670 A1 3/2009 Solbeck et al.
2009/0086990 A1 4/2009 Christoph
2009/0136057 A1 5/2009 Taenzer
2009/0175461 A1 7/2009 Nakamura et al.
2009/0175466 A1 7/2009 Elko et al.
2009/0196429 A1 8/2009 Ramakrishnan et al.
2009/0220107 A1 9/2009 Every et al.
2009/0238369 A1 9/2009 Ramakrishnan et al.
2009/0245529 A1 10/2009 Asada et al.
2009/0254340 A1 10/2009 Sun et al.
2009/0290718 A1 11/2009 Kahn et al.
2009/0296965 A1 12/2009 Kojima
2009/0304200 A1 12/2009 Kim et al.
2009/0311979 A1 12/2009 Husted et al.
2010/0014683 A1 1/2010 Maeda et al.
2010/0014685 A1 1/2010 Wurm
2010/0061564 A1 3/2010 Clemow et al.
2010/0069114 A1 3/2010 Lee et al.
2010/0082339 A1 4/2010 Konchitsky et al.
2010/0098263 A1 4/2010 Pan et al.
2010/0098265 A1 4/2010 Pan et al.
2010/0124335 A1 5/2010 Wessling et al.
2010/0124336 A1 5/2010 Shridhar et al.
2010/0124337 A1 5/2010 Wertz et al.
2010/0131269 A1 5/2010 Park et al.

(56) References Cited

U.S. PATENT DOCUMENTS

2010/0142715 A1 6/2010 Goldstein et al.
2010/0150367 A1 6/2010 Mizuno
2010/0158330 A1 6/2010 Guissin et al.
2010/0166203 A1 7/2010 Peissig et al.
2010/0183175 A1 7/2010 Chen et al.
2010/0195838 A1 8/2010 Bright
2010/0195844 A1 8/2010 Christoph et al.
2010/0207317 A1 8/2010 Iwami et al.
2010/0246855 A1 9/2010 Chen
2010/0266137 A1 10/2010 Sibbald et al.
2010/0272276 A1 10/2010 Carreras et al.
2010/0272283 A1 10/2010 Carreras et al.
2010/0272284 A1 10/2010 Joho et al.
2010/0274564 A1 10/2010 Bakalos et al.
2010/0284546 A1 11/2010 DeBrunner et al.
2010/0291891 A1 11/2010 Ridgers et al.
2010/0296666 A1 11/2010 Lin
2010/0296668 A1 11/2010 Lee et al.
2010/0310086 A1 12/2010 Magrath et al.
2010/0310087 A1 12/2010 Ishida
2010/0316225 A1 12/2010 Saito et al.
2010/0322430 A1 12/2010 Isberg
2011/0002468 A1 1/2011 Tanghe
2011/0007907 A1 1/2011 Park et al.
2011/0026724 A1 2/2011 Doclo
2011/0096933 A1 4/2011 Eastty
2011/0099010 A1 4/2011 Zhang
2011/0106533 A1 5/2011 Yu
2011/0116643 A1 5/2011 Tiscareno et al.
2011/0129098 A1 6/2011 Delano et al.
2011/0130176 A1 6/2011 Magrath et al.
2011/0142247 A1 6/2011 Fellers et al.
2011/0144984 A1 6/2011 Konchitsky
2011/0150257 A1 6/2011 Jensen
2011/0158419 A1 6/2011 Theverapperuma et al.
2011/0206214 A1 8/2011 Christoph et al.
2011/0222698 A1 9/2011 Asao et al.
2011/0222701 A1 9/2011 Donaldson
2011/0249826 A1 10/2011 Van Leest
2011/0288860 A1 11/2011 Schevciw et al.
2011/0293103 A1 12/2011 Park et al.
2011/0299695 A1 12/2011 Nicholson
2011/0305347 A1 12/2011 Wurm
2011/0317848 A1 12/2011 Ivanov et al.
2012/0057720 A1 3/2012 Van Leest
2012/0084080 A1 4/2012 Konchitsky et al.
2012/0135787 A1 5/2012 Kusunoki et al.
2012/0140917 A1 6/2012 Nicholson et al.
2012/0140942 A1 6/2012 Loeda
2012/0140943 A1 6/2012 Hendrix et al.
2012/0148062 A1 6/2012 Scarlett et al.
2012/0155666 A1 6/2012 Nair
2012/0170766 A1 7/2012 Alves et al.
2012/0179458 A1 7/2012 Oh et al.
2012/0207317 A1 8/2012 Abdollahzadeh Milani et al.
2012/0215519 A1 8/2012 Park et al.
2012/0250873 A1 10/2012 Bakalos et al.
2012/0259626 A1 10/2012 Li et al.
2012/0263317 A1 10/2012 Shin et al.
2012/0281850 A1 11/2012 Hyatt
2012/0300958 A1 11/2012 Klemmensen
2012/0300960 A1 11/2012 Mackay et al.
2012/0308021 A1 12/2012 Kwatra et al.
2012/0308024 A1 12/2012 Alderson et al.
2012/0308025 A1 12/2012 Hendrix et al.
2012/0308026 A1 12/2012 Kamath et al.
2012/0308027 A1 12/2012 Kwatra
2012/0308028 A1 12/2012 Kwatra et al.
2012/0310640 A1 12/2012 Kwatra et al.
2012/0316872 A1 12/2012 Stoltz et al.
2013/0010982 A1 1/2013 Elko et al.
2013/0083939 A1 4/2013 Fellers et al.
2013/0156238 A1* 6/2013 Birch ..... G10K 11/178 381/309
2013/0222516 A1 8/2013 Do et al.
2013/0243198 A1 9/2013 Van Rumpt
2013/0243225 A1 9/2013 Yokota
2013/0259251 A1 10/2013 Bakalos
2013/0272539 A1 10/2013 Kim et al.
2013/0287218 A1 10/2013 Alderson et al.
2013/0287219 A1 10/2013 Hendrix et al.
2013/0301842 A1 11/2013 Hendrix et al.
2013/0301846 A1 11/2013 Alderson et al.
2013/0301847 A1 11/2013 Alderson et al.
2013/0301848 A1 11/2013 Zhou et al.
2013/0301849 A1 11/2013 Alderson
2013/0315403 A1 11/2013 Samuelsson
2013/0343556 A1 12/2013 Bright
2013/0343571 A1 12/2013 Rayala et al.
2014/0036127 A1 2/2014 Pong et al.
2014/0044275 A1 2/2014 Goldstein et al.
2014/0050332 A1 2/2014 Nielsen et al.
2014/0051483 A1 2/2014 Schoerkmaier
2014/0072134 A1 3/2014 Po et al.
2014/0072135 A1 3/2014 Bajic et al.
2014/0086425 A1 3/2014 Jensen et al.
2014/0126735 A1 5/2014 Gauger, Jr.
2014/0169579 A1 6/2014 Azmi
2014/0177851 A1 6/2014 Kitazawa et al.
2014/0177890 A1 6/2014 Hojlund et al.
2014/0211953 A1 7/2014 Alderson et al.
2014/0226827 A1 8/2014 Abdollahzadeh Milani et al.
2014/0270222 A1 9/2014 Hendrix et al.
2014/0270223 A1 9/2014 Li et al.
2014/0270224 A1 9/2014 Zhou et al.
2014/0294182 A1 10/2014 Axelsson
2014/0307887 A1 10/2014 Alderson et al.
2014/0307888 A1 10/2014 Alderson et al.
2014/0307890 A1 10/2014 Zhou et al.
2014/0307899 A1 10/2014 Hendrix et al.
2014/0314244 A1 10/2014 Yong et al.
2014/0314246 A1 10/2014 Hellman
2014/0314247 A1 10/2014 Zhang
2014/0341388 A1 11/2014 Goldstein
2014/0369517 A1 12/2014 Zhou et al.
2015/0078572 A1 3/2015 Milani et al.
2015/0092953 A1 4/2015 Abdollahzadeh Milani et al.
2015/0104032 A1 4/2015 Kwatra et al.
2015/0161980 A1 6/2015 Alderson et al.
2015/0161981 A1 6/2015 Kwatra
2015/0163592 A1 6/2015 Alderson
2015/0256660 A1 9/2015 Kaller et al.
2015/0256953 A1 9/2015 Kwatra et al.
2015/0269926 A1 9/2015 Alderson et al.
2015/0365761 A1 12/2015 Alderson et al.
2016/0180830 A1 6/2016 Lu et al.

FOREIGN PATENT DOCUMENTS

EP 0756407 A2 1/1997
EP 0898266 A2 2/1999
EP 1691577 A2 8/2006
EP 1880699 A2 1/2008
EP 1947642 A1 7/2008
EP 2133866 A1 12/2009
EP 2237573 A1 10/2010
EP 2216774 A1 8/2011
EP 239550 A1 12/2011
EP 2395501 A1 12/2011
EP 2551845 A1 1/2013
EP 2583074 A1 4/2013
GB 2401744 A 11/2004
GB 2436657 A 10/2007
GB 2155824 A 6/2009
GB 2455821 A 6/2009
GB 2455828 A 6/2009
GB 2484722 A 4/2012
JP H05265468 10/1993
JP H06186985 A 7/1994
JP H06232755 8/1994
JP 07098592 4/1995
JP 07325588 A 12/1995
JP H07334169 12/1995
JP H08227322 9/1996

(56) References Cited

FOREIGN PATENT DOCUMENTS

| | | | |
|---|---|---|---|
| JP | H10247088 | | 9/1998 |
| JP | H10257159 | | 9/1998 |
| JP | H11305783 | A | 11/1999 |
| JP | 2000089770 | | 3/2000 |
| JP | 2002010355 | | 1/2002 |
| JP | 2004007107 | | 1/2004 |
| JP | 2006217542 | A | 8/2006 |
| JP | 2007060644 | | 3/2007 |
| JP | 2008015046 | A | 1/2008 |
| JP | 2010277025 | | 12/2010 |
| JP | 2011061449 | | 3/2011 |
| WO | 93/04529 | A1 | 3/1993 |
| WO | 9911045 | | 3/1999 |
| WO | 03015074 | A1 | 2/2003 |
| WO | 03015275 | A1 | 2/2003 |
| WO | WO2004009007 | A1 | 1/2004 |
| WO | 2004017303 | A1 | 2/2004 |
| WO | 2006125061 | A1 | 11/2006 |
| WO | 2006128768 | A1 | 12/2006 |
| WO | 2007007916 | A1 | 1/2007 |
| WO | 2007011337 | A1 | 1/2007 |
| WO | 2007110807 | A2 | 10/2007 |
| WO | 2007113487 | A1 | 11/2007 |
| WO | 2009041012 | A1 | 4/2009 |
| WO | 2009110087 | A1 | 9/2009 |
| WO | 2010117714 | A1 | 10/2010 |
| WO | 2011035061 | A1 | 3/2011 |
| WO | 2012107561 | A1 | 8/2012 |
| WO | 2012119808 | A2 | 9/2012 |
| WO | 2012134874 | A1 | 10/2012 |
| WO | 2012166273 | A2 | 12/2012 |
| WO | 2012166388 | A2 | 12/2012 |
| WO | 2013106370 | A1 | 7/2013 |
| WO | 2014158475 | A1 | 10/2014 |
| WO | 2014168685 | A2 | 10/2014 |
| WO | 2014172005 | A1 | 10/2014 |
| WO | 2014172006 | A1 | 10/2014 |
| WO | 2014172010 | A1 | 10/2014 |
| WO | 2014172019 | A1 | 10/2014 |
| WO | 2014172021 | A1 | 10/2014 |
| WO | 2014200787 | A1 | 12/2014 |
| WO | 2015038255 | A1 | 3/2015 |
| WO | 2015088639 | A | 6/2015 |
| WO | 2015088639 | A1 | 6/2015 |
| WO | 2015088651 | A1 | 6/2015 |
| WO | 2015088653 | A1 | 6/2015 |
| WO | 2015134225 | A1 | 9/2015 |
| WO | 2015191691 | A1 | 12/2015 |
| WO | 2016100602 | A1 | 6/2016 |

OTHER PUBLICATIONS

International Patent Application No. PCT/US2014/061753, International Search Report and Written Opinion, Feb. 9, 2015, 8 pages.
International Patent Application No. PCT/US2014/061548, International Search Report and Written Opinion, Feb. 12, 2015, 13 pages.
International Patent Application No. PCT/US2014/060277, International Search Report and Written Opinion, Mar. 9, 2015, 11 pages.
Kuo, Sen and Tsai, Jianming, Residual noise shaping technique for active noise control systems, J. Acoust. Soc. Am. 95 (3), Mar. 1994, pp. 1665-1668.
Ray, Laura et al., Hybrid Feedforward-Feedback Active Noise Reduction for Hearing Protection and Communication, The Journal of the Acoustical Society of America, American Institute of Physics for the Acoustical Society of America, New York, NY, vol. 120, No. 4, Jan. 2006, pp. 2026-2036.
International Patent Application No. PCT/US2014/017112, International Search Report and Written Opinion, May 8, 2015, 22 pages.
Milani, et al., "On Maximum Achievable Noise Reduction in ANC Systems", Proceedings of the IEEE International Conference on Acoustics, Speech, and Signal Processing, ICASSP 2010, Mar. 14-19, 2010 pp. 349-352.
Ryan, et al., "Optimum near-field performance of microphone arrays subject to a far-field beampattern constraint", 2248 J. Acoust. Soc. Am. 108, Nov. 2000.
Cohen, et al., "Noise Estimation by Minima Controlled Recursive Averaging for Robust Speech Enhancement", IEEE Signal Processing Letters, vol. 9, No. 1, Jan. 2002.
Martin, "Noise Power Spectral Density Estimation Based on Optimal Smoothing and Minimum Statistics", IEEE Trans. on Speech and Audio Processing, col. 9, No. 5, Jul. 2001.
Martin, "Spectral Subtraction Based on Minimum Statistics", Proc. 7th EUSIPCO '94, Edinburgh, U.K., Sep. 13-16, 1994, pp. 1182-1195.
Cohen, "Noise Spectrum Estimation in Adverse Environments: Improved Minima Controlled Recursive Averaging", IEEE Trans. on Speech & Audio Proc., vol. 11, Issue 5, Sep. 2003.
Black, John W., "An Application of Side-Tone in Subjective Tests of Microphones and Headsets", Project Report No. NM 001 064. 01.20, Research Report of the U.S. Naval School of Aviation Medicine, Feb. 1, 1954, 12 pages (pp. 1-12 in pdf), Pensacola, FL, US.
Lane, et al., "Voice Level: Autophonic Scale, Perceived Loudness, and the Effects of Sidetone", The Journal of the Acoustical Society of America, Feb. 1961, pp. 160-167, vol. 33, No. 2., Cambridge, MA, US.
Liu, et al., "Compensatory Responses to Loudness-shifted Voice Feedback During Production of Mandarin Speech", Journal of the Acoustical Society of America, Oct. 2007, pp. 2405-2412, vol. 122, No. 4.
Paepcke, et al., "Yelling in the Hall: Using Sidetone to Address a Problem with Mobile Remote Presence Systems", Symposium on User Interface Software and Technology, Oct. 16-19, 2011, 10 pages (pp. 1-10 in pdf), Santa Barbara, CA, US.
Peters, Robert W., "The Effect of High-Pass and Low-Pass Filtering of Side-Tone Upon Speaker Intelligibility", Project Report No. NM 001 064.01.25, Research Report of the U.S. Naval School of Aviation Medicine, Aug. 16, 1954, 13 pages (pp. 1-13 in pdf), Pensacola, FL, US.
Therrien, et al., "Sensory Attenuation of Self-Produced Feedback: The Lombard Effect Revisited", PLOS ONE, Nov. 2012, pp. 1-7, vol. 7, Issue 11, e49370, Ontario, Canada.
Campbell, Mikey, "Apple looking into self-adjusting earbud headphones with noise cancellation tech", Apple Insider, Jul. 4, 2013, pp. 1-10 (10 pages in pdf), downloaded on May 14, 2014 from http://appleinsider.com/articles/13/07/04/apple-looking-into-self-adjusting-earbud-headphones-with-noise-cancellation-tech.
International Patent Application No. PCT/US2014/017096, International Search Report and Written Opinion, May 27, 2014, 11 pages.
Jin, et al., "A simultaneous equation method-based online secondary path modeling algorithm for active noise control", Journal of Sound and Vibration, Apr. 25, 2007, pp. 455-474, vol. 303, No. 3-5, London, GB.
Erkelens et al., "Tracking of Nonstationary Noise Based on Data-Driven Recursive Noise Power Estimation", IEEE Transactions on Audio Speech, and Language Processing, vol. 16, No. 6, Aug. 2008.
Rao et al., "A Novel Two Stage Single Channle Speech Enhancement Technique", India Conference (INDICON) 2011 Annual IEEE, IEEE, Dec. 15, 2011.
Rangachari et al., "A noise-estimation algorithm for highly non-stationary environments" Speech Communication, Elsevier Science Publishers, vol. 48, No. 2, Feb. 1, 2006.
Pfann, et al., "LMS Adaptive Filtering with Delta-Sigma Modulated Inout Signals," IEEE Signal Processing Letters, Apr. 1998, pp. 95-97, vol. 5, No. 4, IEEE Press, Piscataway, NJ.
Toochinda, et al. "A Single-Input Two-Output Feedback Formulation for ANC Problems," Proceedings of the 2001 American Control Conference, Jun. 2001, pp. 923-928, vol. 2, Arlington, VA.
Kuo, et al., "Active Noise Control: A Tutorial Review," Proceedings of the IEEE, Jun. 1999, pp. 943-973, vol. 87, No. 6, IEEE Press, Piscataway, NJ.
Johns, et al., "Continuous-Time LMS Adaptive Recursive Filters," IEEE Transactions on Circuits and Systems, Jul. 1991, pp. 769-778, vol. 38, No. 7, IEEE Press, Piscataway, NJ.

(56) References Cited

OTHER PUBLICATIONS

Shoval, et al., "Comparison of DC Offset Effects in Four LMS Adaptive Algorithms," IEEE Transactions on Circuits and Systems II: Analog and Digital Processing, Mar. 1995, pp. 176-185, vol. 42, Issue 3, IEEE Press, Piscataway, NJ.
Mali, Dilip, "Comparison of DC Offset Effects on LMS Algorithm and its Derivatives," International Journal of Recent Trends in Engineering, May 2009, pp. 323-328, vol. 1, No. 1, Academy Publisher.
Kates, James M., "Principles of Digital Dynamic Range Compression," Trends in Amplification, Spring 2005, pp. 45-76, vol. 9, No. 2, Sage Publications.
Gao, et al., "Adaptive Linearization of a Loudspeaker," IEEE International Conference on Acoustics, Speech, and Signal Processing, Apr. 14-17, 1991, pp. 3589-3592, Toronto, Ontario, CA.
Silva, et al., "Convex Combination of Adaptive Filters With Different Tracking Capabilities," IEEE International Conference on Acoustics, Speech, and Signal Processing, Apr. 15-20, 2007, pp. III 925-III 928, vol. 3, Honolulu, HI, USA.
Akhtar, et al., "A Method for Online Secondary Path Modeling in Active Noise Control Systems," IEEE International Symposium on Circuits and Systems, May 23-26, 2005, pp. 264-267, vol. 1, Kobe, Japan.
Davari, et al., "A New Online Secondary Path Modeling Method for Feedforward Active Noise Control Systems," IEEE International Conference on Industrial Technology, Apr. 21-24, 2008, pp. 1-6, Chengdu, China.
Lan, et al., "An Active Noise Control System Using Online Secondary Path Modeling With Reduced Auxiliary Noise," IEEE Signal Processing Letters, Jan. 2002, pp. 16-18, vol. 9, Issue 1, IEEE Press, Piscataway, NJ.
Liu, et al., "Analysis of Online Secondary Path Modeling With Auxiliary Noise Scaled by Residual Noise Signal," IEEE Transactions on Audio, Speech and Language Processing, Nov. 2010, pp. 1978-1993, vol. 18, Issue 8, IEEE Press, Piscataway, NJ.
D. Senderowicz et al., "Low-Voltage Double-Sampled Delta-Sigma Converters," IEEE J. Solid-State Circuits, vol. 37, pp. 1215-1225, Dec. 1997, 13 pages.
P.J. Hurst and K.C. Dyer, "An improved double sampling scheme for switched-capacitor delta-sigma modulators," IEEE Int. Symp. Circuits Systems, May 1992, vol. 3, pp. 1179-1182, 4 pages.
Lopez-Caudana, Edgar Omar, Active Noise Cancellation: The Unwanted Signal and the Hybrid Solution, Adaptive Filtering Applications, Dr. Lino Garcia, ISBN: 978-953-307-306-4, InTech.
Booji, P.S., Berkhoff, A.P., Virtual sensors for local, three dimensional, broadband multiple-channel active noise control and the effects on the quiet zones, Proceedings of ISMA2010 including USD2010, pp. 151-166.
Widrow, B. et al., Adaptive Noise Cancelling: Principles and Applications, Proceedings of the IEEE, IEEE, New York, NY, U.S., vol. 63, No. 13, Dec. 1975, pp. 1692-1716.
Morgan, Dennis R. et al., A Delayless Subband Adaptive Filter Architecture, IEEE Transactions on Signal Processing, IEEE Service Center, New York, NY, U.S., vol. 43, No. 8, Aug. 1995, pp. 1819-1829.
International Patent Application No. PCT/US2014/040999, International Search Report and Written Opinion, Oct. 18, 2014, 12 pages.
International Patent Application No. PCT/US2013/049407, International Search Report and Written Opinion, Jun. 18, 2014, 13 pages.
International Search Report and Written Opinion of the International Searching Authority, International Patent Application No. PCT/US2014/017343, mailed Aug. 8, 2014, 22 pages.
International Search Report and Written Opinion of the International Searching Authority, International Patent Application No. PCT/US2014/018027, mailed Sep. 4, 2014, 14 pages.
International Search Report and Written Opinion of the International Searching Authority, International Patent Application No. PCT/US2014/017374, mailed Sep. 8, 2014, 13 pages.
International Search Report and Written Opinion of the International Searching Authority, International Patent Application No. PCT/US2014/019395, mailed Sep. 9, 2014, 14 pages.
International Search Report and Written Opinion of the International Searching Authority, International Patent Application No. PCT/US2014/019469, mailed Sep. 12, 2014, 13 pages.
Feng, Jinwei et al., "A broadband self-tuning active noise equaliser", Signal Processing, Elsevier Science Publishers B.V. Amsterdam, NL, vol. 62, No. 2, Oct. 1, 1997, pp. 251-256.
Zhang, Ming et al., "A Robust Online Secondary Path Modeling Method with Auxiliary Noise Power Scheduling Strategy and Norm Constraint Manipulation", IEEE Transactions on Speech and Audio Processing, IEEE Service Center, New York, NY, vol. 11, No. 1, Jan. 1, 2003.
Lopez-Gaudana, Edgar et al., "A hybrid active noise cancelling with secondary path modeling", 51st Midwest Symposium on Circuits and Systems, 2008, MWSCAS 2008, Aug. 10, 2008, pp. 277-280.
International Patent Application No. PCT/US2015/017124, International Search Report and Written Opinion, Jul. 13, 2015, 19 pages.
International Patent Application No. PCT/US2015/035073, International Search Report and Written Opinion, Oct. 8, 2015, 11 pages.
Parkins, et al., Narrowband and broadband active control in an enclosure using the acoustic energy density, J. Acoust. Soc. Am. Jul. 2000, pp. 192-203, vol. 108, issue 1, U.S.
International Patent Application No. PCT/US2015/022113, International Search Report and Written Opinion, Jul. 23, 2015, 13 pages.
Combined Search and Examination Report, Application No. GB1512832.5, mailed Jan. 28, 2016, 7 pages.
International Patent Application No. PCT/US2015/066260, International Search Report and Written Opinion, Apr. 21, 2016, 13 pages.
English machine translation of JP 2006-217542 A (Okumura, Hiroshi; Howling Suppression Device and Loudspeaker, published Aug. 2006).
Combined Search and Examination Report, Application No. GB1519000.2, mailed Apr. 21, 2016, 5 pages.
Examination Report under Section 18(3), United Kingdom Application No. GB1512832.5, mailed Feb. 2, 2017.

* cited by examiner

SYSTEMS AND METHODS FOR SHARING SECONDARY PATH INFORMATION BETWEEN AUDIO CHANNELS IN AN ADAPTIVE NOISE CANCELLATION SYSTEM

FIELD OF DISCLOSURE

The present disclosure relates in general to adaptive noise cancellation in connection with an acoustic transducer, and more particularly, to sharing information between audio channels in an adaptive noise cancellation system.

BACKGROUND

Wireless telephones, such as mobile/cellular telephones, cordless telephones, and other consumer audio devices, such as mp3 players, are in widespread use. Performance of such devices with respect to intelligibility can be improved by providing noise canceling using a microphone to measure ambient acoustic events and then using signal processing to insert an anti-noise signal into the output of the device to cancel the ambient acoustic events. Because the acoustic environment around personal audio devices such as wireless telephones can change dramatically, depending on the sources of noise that are present and the position of the device itself, it is desirable to adapt the noise canceling to take into account such environmental changes.

Because the acoustic environment around personal audio devices, such as wireless telephones, can change dramatically, depending on the sources of noise that are present and the position of the device itself, it is desirable to adapt the noise canceling to take into account such environmental changes. For example, many adaptive noise canceling systems utilize an error microphone for sensing acoustic pressure proximate to an output of an electro-acoustic transducer (e.g., a loudspeaker) and generating an error microphone signal indicative of the acoustic output of the transducer and the ambient audio sounds at the transducer. When the transducer is close to a listener's ear, the error microphone signal may approximate the actual acoustic pressure at a listener's eardrum (a location known as a drum reference point). However, because of the distance between the drum reference point and the location of the error microphone (known as the error reference point), the error microphone signal is only an approximation and not a perfect indication of acoustic pressure at the drum reference point. Thus, because noise cancellation attempts to reduce ambient audio sounds present in the error microphone signal, performance of a noise cancellation system may be the greatest when the distance between the drum reference point and the error reference point is small. As the distance increases (e.g., transducer held against the ear at a lower pressure), the performance of the noise cancellation system may degrade, partly because the gain of the transfer function from the error reference point to the drum reference point decreases with such increased distance. This degradation is not accounted for in traditional adaptive noise cancellation systems.

SUMMARY

In accordance with the teachings of the present disclosure, the disadvantages and problems associated with improving audio performance of a personal audio device may be reduced or eliminated.

In accordance with embodiments of the present disclosure, an integrated circuit for implementing at least a portion of a personal audio device may include a first output, a first error microphone input, a second output, a second error microphone input, and a processing circuit. The first output may provide a first output signal to a first transducer including both a first source audio signal for playback to a listener and a first anti-noise signal for countering the effect of ambient audio sounds in an acoustic output of the first transducer. The first error microphone input may receive a first error microphone signal indicative of the output of the first transducer and the ambient audio sounds at the first transducer. The second output may provide a second output signal to a second transducer including both a second source audio signal for playback to the listener and a second anti-noise signal for countering the effect of ambient audio sounds in an acoustic output of the second transducer. The second error microphone input may receive a second error microphone signal indicative of the output of the second transducer and the ambient audio sounds at the second transducer. The processing circuit may implement a first secondary path estimate adaptive filter for modeling an electro-acoustic path of the first source audio signal through the first transducer and having a response that generates a first secondary path estimate signal from the first source audio signal, a first coefficient control block that shapes the response of the first secondary path estimate adaptive filter in conformity with the first source audio signal and a first playback corrected error by adapting the response of the first secondary path estimate filter to minimize the first playback corrected error, wherein the first playback corrected error is based on a difference between the first error microphone signal and the first secondary path estimate signal, a second secondary path estimate adaptive filter for modeling an electro-acoustic path of the second source audio signal through the second transducer and having a response that generates a second secondary path estimate signal from the second source audio signal, a second coefficient control block that shapes the response of the second secondary path estimate adaptive filter in conformity with the second source audio signal and a second playback corrected error by adapting the response of the second secondary path estimate filter to minimize the second playback corrected error, wherein the second playback corrected error is based on a difference between the second error microphone signal and the second secondary path estimate signal, a first filter that generates the first anti-noise signal to reduce the presence of the ambient audio sounds at the acoustic output of the first transducer based at least on the first playback corrected error, a second filter that generates the second anti-noise signal to reduce the presence of the ambient audio sounds at the acoustic output of the second transducer based at least on the second playback corrected error, and a comparison block that compares the response of the first secondary path estimate adaptive filter and the response of the second secondary path estimate adaptive filter.

In accordance with these and other embodiments of the present disclosure, a method for canceling ambient audio sounds in the respective proximities of transducers associated with a personal audio device may include receiving a first error microphone signal indicative of an output of a first transducer and the ambient audio sounds at the first transducer. The method may also include receiving a second error microphone signal indicative of an output of a second transducer and the ambient audio sounds at the second transducer. The method may also include generating a first secondary path estimate signal from a first source audio signal by filtering the first source audio signal with a first secondary path estimate filter for modeling an electro-acoustic path of the source audio signal through the first transducer, wherein a response of the first secondary path estimate adaptive filter is shaped in conformity with the first source audio signal and a first playback corrected error by adapting the response of the first secondary path estimate filter to minimize the first playback corrected error, wherein the first playback corrected error is based on a difference between the first error microphone signal and the first secondary path estimate signal. The method may additionally include generating a second secondary path estimate signal from a second source audio signal by filtering the second source audio signal with a second secondary path estimate filter for modeling an electro-acoustic path of the second source audio signal through the second transducer wherein a response of the second secondary path estimate adaptive filter is shaped in conformity with the second source audio signal and a second playback corrected error by adapting the response of the second secondary path estimate filter to minimize the second playback corrected error, wherein the second playback corrected error is based on a difference between the second error microphone signal and the second secondary path estimate signal. The method may additionally include generating a first anti-noise signal to reduce the presence of the ambient audio sounds at the acoustic output of the first transducer based at least on the first playback corrected error. The method may further include generating a second anti-noise signal to reduce the presence of the ambient audio sounds at the acoustic output of the second transducer based at least on the second playback corrected error. The method may further include comparing the response of the first secondary path estimate adaptive filter and the response of the second secondary path estimate adaptive filter.

In accordance with these and other embodiments of the present disclosure, an integrated circuit for implementing at least a portion of a personal audio device may include a first output, a first error microphone input, a first reference microphone input, a second output, a second error microphone input, a second reference microphone input, and a processing circuit. The first output may provide a first output signal to a first transducer including both a first source audio signal for playback to a listener and a first anti-noise signal for countering the effect of ambient audio sounds in an acoustic output of the first transducer. The first error microphone input may receive a first error microphone signal indicative of the output of the first transducer and the ambient audio sounds at the first transducer. The first reference microphone input may receive a first reference microphone signal indicative of the ambient audio sounds at the acoustic output of the first transducer. The second output may provide a second output signal to a second transducer including both a second source audio signal for playback to the listener and a second anti-noise signal for countering the effect of ambient audio sounds in an acoustic output of the second transducer. The second error microphone input may receive a second error microphone signal indicative of the output of the second transducer and the ambient audio sounds at the second transducer. The second reference microphone input may receive a second reference microphone signal indicative of the ambient audio sounds at the acoustic output of the second transducer. The processing circuit may implement a first adaptive filter that generates the first anti-noise signal from the first reference microphone signal to reduce the presence of the ambient audio sounds at the acoustic output of the first transducer, a second adaptive filter that generates the second anti-noise signal from the second reference microphone signal to reduce the presence of the ambient audio sounds at the acoustic output of the second transducer, a first coefficient control block that shapes the response of the first adaptive filter in conformity with the first error microphone signal and the first reference microphone signal by adapting the response of the first adaptive filter to minimize the ambient audio sounds in the first error microphone signal, a second coefficient control block that shapes the response of the second adaptive filter in conformity with the second error microphone signal and the second reference microphone signal by adapting the response of the second adaptive filter to minimize the ambient audio sounds in the second error microphone signal, and a comparison block that compares the response of the first adaptive filter and the response of the second adaptive filter.

In accordance with these and other embodiments of the present disclosure, a method for canceling ambient audio sounds in the respective proximities of transducers associated with a personal audio device may include receiving a first error microphone signal indicative of an output of a first transducer and the ambient audio sounds at the first transducer, receiving a second error microphone signal indicative of an output of a second transducer and the ambient audio sounds at the second transducer, receiving a first reference microphone signal indicative of the ambient audio sounds at the acoustic output of the first transducer, and receiving a second reference microphone signal indicative of the ambient audio sounds at the acoustic output of the second transducer. The method may also include generating, by a first adaptive filter, a first anti-noise signal from the first reference microphone signal to reduce the presence of the ambient audio sounds at the acoustic output of the first transducer and generating, by a second adaptive filter, a second anti-noise signal from the second reference microphone signal to reduce the presence of the ambient audio sounds at the acoustic output of the second transducer. The method may additionally include shaping, by a first anti-noise path coefficient control block, a response of the first filter in conformity with the first error microphone signal and the first reference microphone signal by adapting the response of the first filter to minimize the ambient audio sounds in the first error microphone signal and shaping, by a second anti-noise path coefficient control block, a response of the second filter in conformity with the second error microphone signal and the second reference microphone signal by adapting the response of the second filter to minimize the ambient audio sounds in the second error microphone signal. The method may further include comparing the response of the first adaptive filter and the response of the second adaptive filter.

Technical advantages of the present disclosure may be readily apparent to one of ordinary skill in the art from the figures, description and claims included herein. The objects and advantages of the embodiments will be realized and achieved at least by the elements, features, and combinations particularly pointed out in the claims.

It is to be understood that both the foregoing general description and the following detailed description are examples and explanatory and are not restrictive of the claims set forth in this disclosure.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

Figure 1A:
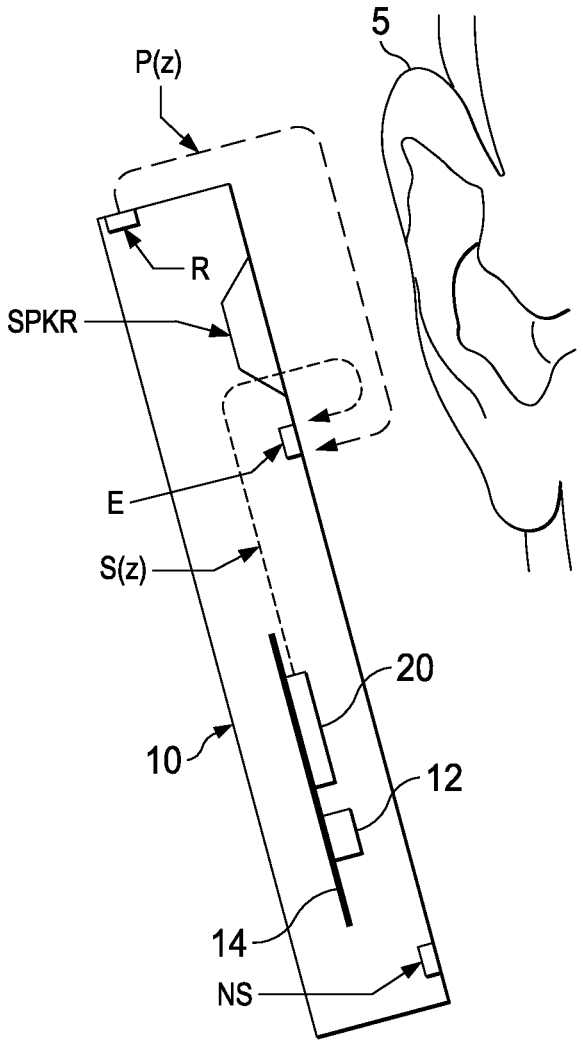
FIG. 1A is an illustration of an example personal audio device, in accordance with embodiments of the present disclosure.

Referring now to FIG. 1A, a personal audio device 10 as illustrated in accordance with embodiments of the present disclosure is shown in proximity to a human ear 5. Personal audio device 10 is an example of a device in which techniques in accordance with embodiments of the invention may be employed, but it is understood that not all of the elements or configurations embodied in illustrated personal audio device 10, or in the circuits depicted in subsequent illustrations, are required in order to practice the invention recited in the claims. Personal audio device 10 may include a transducer such as speaker SPKR that reproduces distant speech received by personal audio device 10, along with other local audio events such as ringtones, stored audio program material, injection of near-end speech (i.e., the speech of the user of personal audio device 10) to provide a balanced conversational perception, and other audio that requires reproduction by personal audio device 10, such as sources from webpages or other network communications received by personal audio device 10 and audio indications such as a low battery indication and other system event notifications. A near-speech microphone NS may be provided to capture near-end speech, which is transmitted from personal audio device 10 to the other conversation participant(s).

Personal audio device 10 may include adaptive noise cancellation (ANC) circuits and features that inject an anti-noise signal into speaker SPKR to improve intelligibility of the distant speech and other audio reproduced by speaker SPKR. A reference microphone R may be provided for measuring the ambient acoustic environment, and may be positioned away from the typical position of a user's mouth, so that the near-end speech may be minimized in the signal produced by reference microphone R. Another microphone, error microphone E, may be provided in order to further improve the ANC operation by providing a measure of the ambient audio combined with the audio reproduced by speaker SPKR close to ear 5, when personal audio device 10 is in close proximity to ear 5. Circuit 14 within personal audio device 10 may include an audio CODEC integrated circuit (IC) 20 that receives the signals from reference microphone R, near-speech microphone NS, and error microphone E, and interfaces with other integrated circuits such as a radio-frequency (RF) integrated circuit 12 having a personal audio device transceiver. In some embodiments of the disclosure, the circuits and techniques disclosed herein may be incorporated in a single integrated circuit that includes control circuits and other functionality for implementing the entirety of the personal audio device, such as an MP3 player-on-a-chip integrated circuit. In these and other embodiments, the circuits and techniques disclosed herein may be implemented partially or fully in software and/or firmware embodied in computer-readable media and executable by a controller or other processing device.

In general, ANC techniques of the present disclosure measure ambient acoustic events (as opposed to the output of speaker SPKR and/or the near-end speech) impinging on reference microphone R, and by also measuring the same ambient acoustic events impinging on error microphone E, ANC processing circuits of personal audio device 10 adapt an anti-noise signal generated out the output of speaker SPKR from the output of reference microphone R to have a characteristic that minimizes the amplitude of the ambient acoustic events at error microphone E. Because acoustic path P(z) extends from reference microphone R to error microphone E, ANC circuits are effectively estimating acoustic path P(z) while removing effects of an electro-acoustic path S(z) that represents the response of the audio output circuits of CODEC IC 20 and the acoustic/electric transfer function of speaker SPKR including the coupling between speaker SPKR and error microphone E in the particular acoustic environment, which may be affected by the proximity and structure of ear 5 and other physical objects and human head structures that may be in proximity to personal audio device 10, when personal audio device 10 is not firmly pressed to ear 5. While the illustrated personal audio device 10 includes a two-microphone ANC system with a third near-speech microphone NS, some aspects of the present invention may be practiced in a system that does not include separate error and reference microphones, or a personal audio device that uses near-speech microphone NS to perform the function of the reference microphone R. Also, in personal audio devices designed only for audio playback, near-speech microphone NS will generally not be included, and the near-speech signal paths in the circuits described in further detail below may be omitted, without changing the scope of the disclosure, other than to limit the options provided for input to the microphone covering detection schemes. In addition, although only one reference microphone R is depicted in FIG. 1, the circuits and techniques herein disclosed may be adapted, without changing the scope of the disclosure, to personal audio devices including a plurality of reference microphones.

Figure 1B:
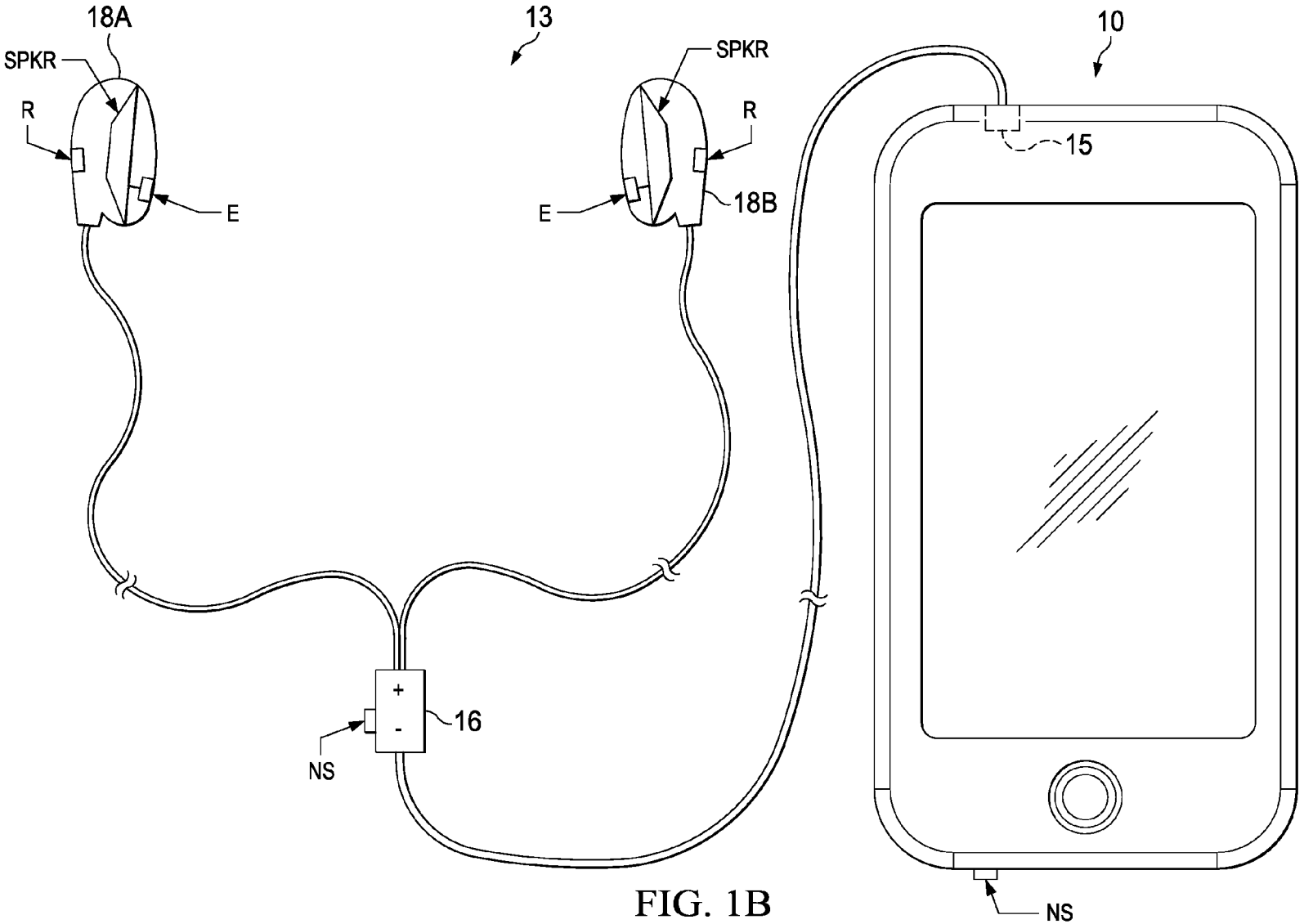
FIG. 1B is an illustration of an example personal audio device with a headphone assembly coupled thereto, in accordance with embodiments of the present disclosure.

Referring now to FIG. 1B, personal audio device 10 is depicted having a headphone assembly 13 coupled to it via audio port 15. Audio port 15 may be communicatively coupled to RF integrated circuit 12 and/or CODEC IC 20, thus permitting communication between components of headphone assembly 13 and one or more of RF integrated circuit 12 and/or CODEC IC 20. As shown in FIG. 1B, headphone assembly 13 may include a combox 16, a left headphone 18A, and a right headphone 18B. As used in this disclosure, the term "headphone" broadly includes any loudspeaker and structure associated therewith that is intended to be mechanically held in place proximate to a listener's ear or ear canal, and includes without limitation earphones, earbuds, and other similar devices. As more specific non-limiting examples, "headphone," may refer to intra-canal earphones, intra-concha earphones, supra-concha earphones, and supra-aural earphones.

Combox 16 or another portion of headphone assembly 13 may have a near-speech microphone NS to capture near-end speech in addition to or in lieu of near-speech microphone NS of personal audio device 10. In addition, each headphone 18A, 18B may include a transducer such as speaker SPKR that reproduces distant speech received by personal audio device 10, along with other local audio events such as ringtones, stored audio program material, injection of near-end speech (i.e., the speech of the user of personal audio device 10) to provide a balanced conversational perception, and other audio that requires reproduction by personal audio device 10, such as sources from webpages or other network communications received by personal audio device 10 and audio indications such as a low battery indication and other system event notifications. Each headphone 18A, 18B may include a reference microphone R for measuring the ambient acoustic environment and an error microphone E for measuring of the ambient audio combined with the audio reproduced by speaker SPKR close to a listener's ear when such headphone 18A, 18B is engaged with the listener's ear. In some embodiments, CODEC IC 20 may receive the signals from reference microphone R, near-speech microphone NS, and error microphone E of each headphone and perform adaptive noise cancellation for each headphone as described herein. In other embodiments, a CODEC IC or another circuit may be present within headphone assembly 13, communicatively coupled to reference microphone R, near-speech microphone NS, and error microphone E, and configured to perform adaptive noise cancellation as described herein.

The various microphones referenced in this disclosure, including reference microphones, error microphones, and near-speech microphones, may comprise any system, device, or apparatus configured to convert sound incident at such microphone to an electrical signal that may be processed by a controller, and may include without limitation an electrostatic microphone, a condenser microphone, an electret microphone, an analog microelectromechanical systems (MEMS) microphone, a digital MEMS microphone, a piezoelectric microphone, a piezo-ceramic microphone, or dynamic microphone.

Figure 2:
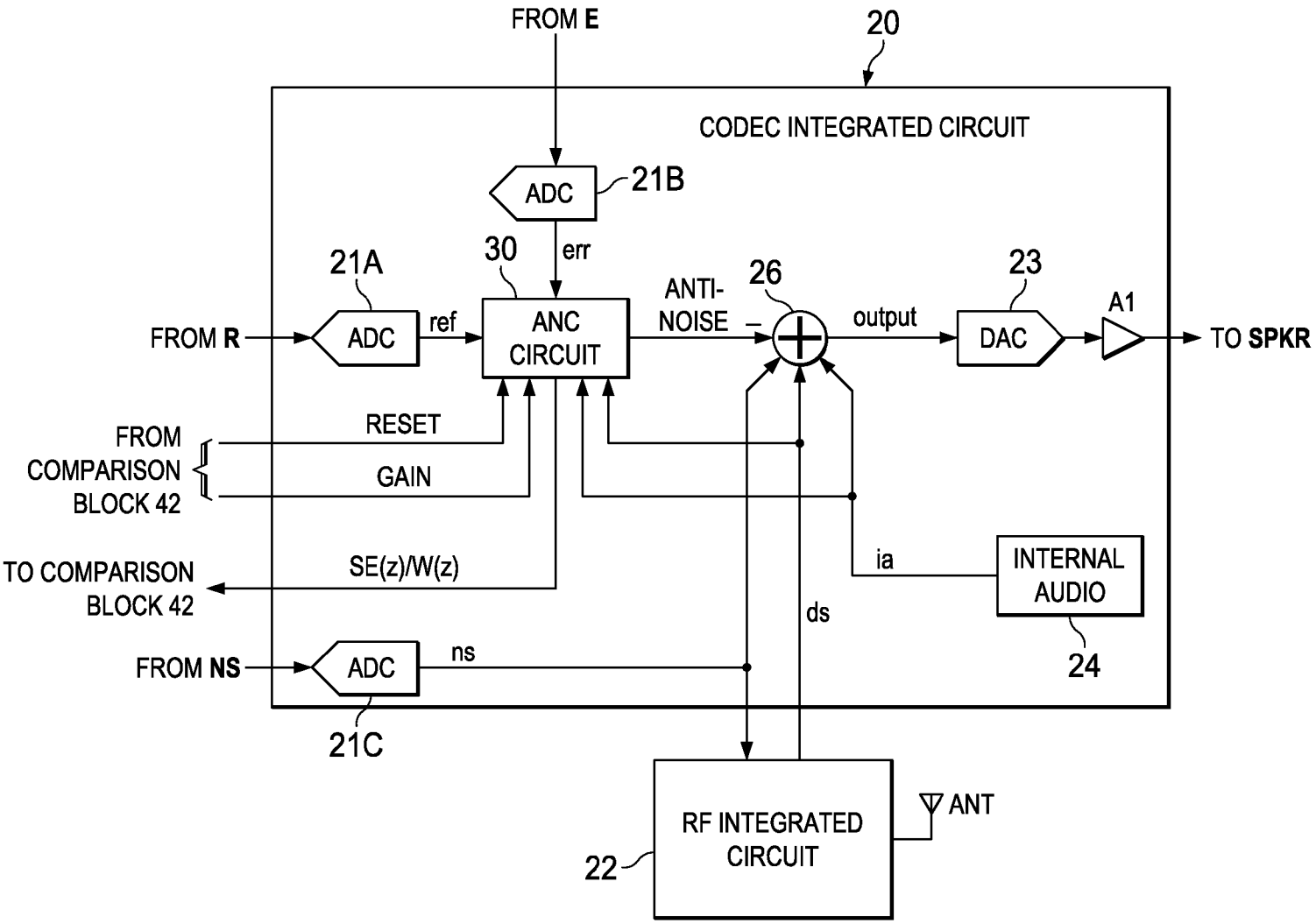
FIG. 2 is a block diagram of selected circuits within the personal audio device depicted in FIGS. 1A and 1B, in accordance with embodiments of the present disclosure.

Referring now to FIG. 2, selected circuits within personal audio device 10, which in other embodiments may be placed in whole or part in other locations such as one or more headphone assemblies 13, are shown in a block diagram. CODEC IC 20 may include an analog-to-digital converter (ADC) 21A for receiving the reference microphone signal and generating a digital representation ref of the reference microphone signal, an ADC 21B for receiving the error microphone signal and generating a digital representation err of the error microphone signal, and an ADC 21C for receiving the near speech microphone signal and generating a digital representation ns of the near speech microphone signal. CODEC IC 20 may generate an output for driving speaker SPKR from an amplifier A1, which may amplify the output of a digital-to-analog converter (DAC) 23 that receives the output of a combiner 26. Combiner 26 may combine audio signals is from internal audio sources 24, the anti-noise signal generated by ANC circuit 30, which by convention has the same polarity as the noise in reference microphone signal ref and is therefore subtracted by combiner 26, and a portion of near speech microphone signal ns so that the user of personal audio device 10 may hear his or her own voice in proper relation to downlink speech ds, which may be received from radio frequency (RF) integrated circuit 22 and may also be combined by combiner 26. Near speech microphone signal ns may also be provided to RF integrated circuit 22 and may be transmitted as uplink speech to the service provider via antenna ANT.

Figure 3:
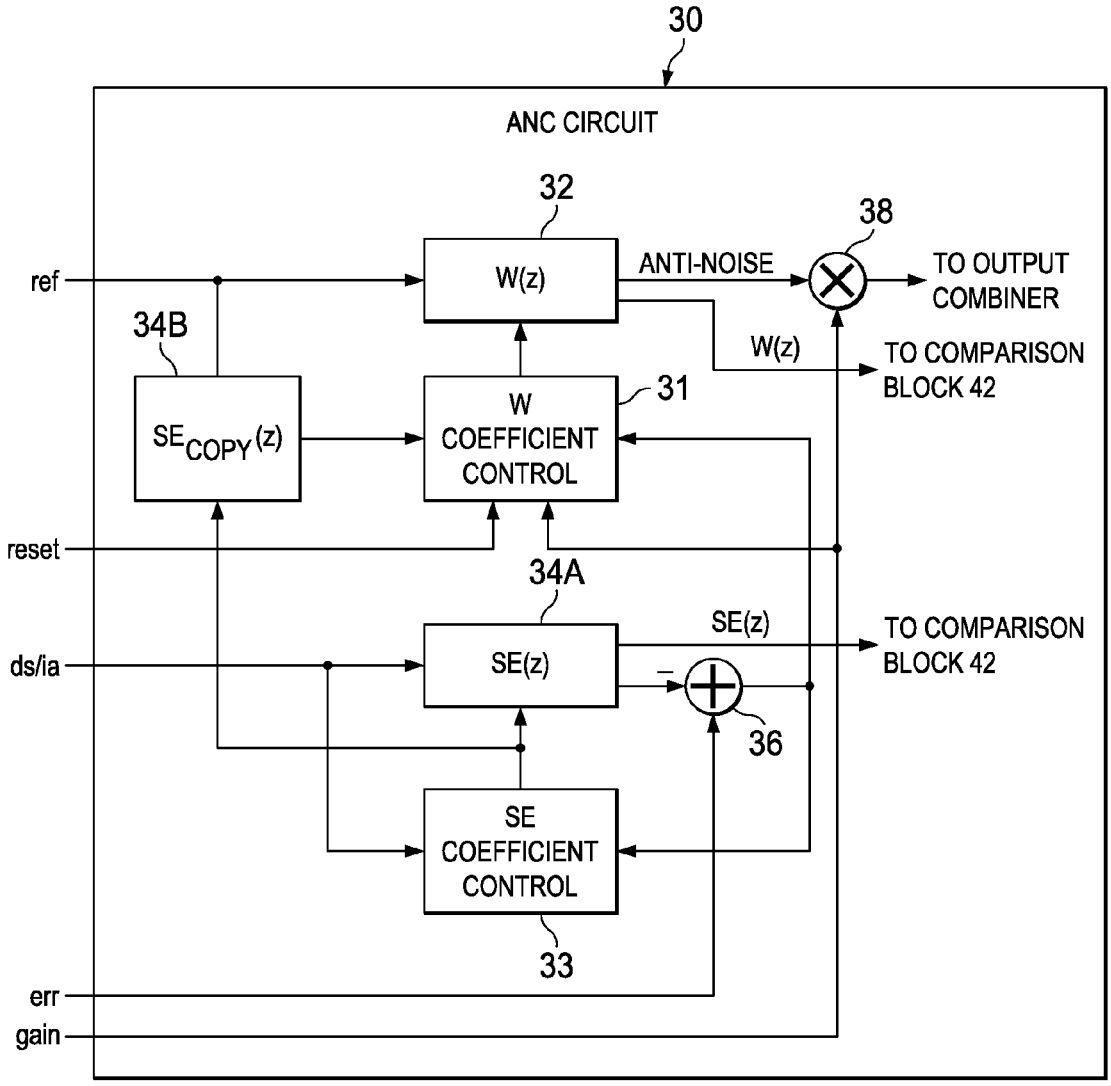
FIG. 3 is a block diagram depicting selected signal processing circuits and functional blocks within an example active noise canceling (ANC) circuit of a coder-decoder (CODEC) integrated circuit of FIG. 3, in accordance with embodiments of the present disclosure.

Referring now to FIG. 3, details of ANC circuit 30 are shown in accordance with embodiments of the present disclosure. Adaptive filter 32 may receive reference microphone signal ref and under ideal circumstances, may adapt its transfer function W(z) to be P(z)/S(z) to generate the anti-noise signal, which may be provided to an output combiner that combines the anti-noise signal with the audio to be reproduced by the transducer, as exemplified by combiner 26 of FIG. 2. The coefficients of adaptive filter 32 may be controlled by a W coefficient control block 31 that uses a correlation of signals to determine the response of adaptive filter 32, which generally minimizes the error, in a least-mean squares sense, between those components of reference microphone signal ref present in error microphone signal err. The signals compared by W coefficient control block 31 may be the reference microphone signal ref as shaped by a copy of an estimate of the response of path S(z) provided by filter 34B and another signal that includes error microphone signal err. By transforming reference microphone signal ref with a copy of the estimate of the response of path S(z), response $SE_{COPY}(z)$, and minimizing the difference between the resultant signal and error microphone signal err, adaptive filter 32 may adapt to the desired response of P(z)/S(z). In addition to error microphone signal err, the signal compared to the output of filter 34B by W coefficient control block 31 may include an inverted amount of downlink audio signal ds and/or internal audio signal ia that has been processed by filter response SE(z), of which response $SE_{COPY}(z)$ is a copy. By injecting an inverted amount of downlink audio signal ds and/or internal audio signal ia, adaptive filter 32 may be prevented from adapting to the relatively large amount of downlink audio and/or internal audio signal present in error microphone signal err and by transforming that inverted copy of downlink audio signal ds and/or internal audio signal ia with the estimate of the response of path S(z), the downlink audio and/or internal audio that is removed from error microphone signal err before comparison should match the expected version of downlink audio signal ds and/or internal audio signal ia reproduced at error microphone signal err, because the electrical and acoustical path of S(z) is the path taken by downlink audio signal ds and/or internal audio signal ia to arrive at error microphone E. As shown in FIGS. 2 and 3, W coefficient control block 31 may also reset signal from a comparison block 42, as described in greater detail below in connection with FIGS. 4 and 5.

Filter 34B may not be an adaptive filter, per se, but may have an adjustable response that is tuned to match the response of adaptive filter 34A, so that the response of filter 34B tracks the adapting of adaptive filter 34A.

To implement the above, adaptive filter 34A may have coefficients controlled by SE coefficient control block 33, which may compare downlink audio signal ds and/or internal audio signal ia and error microphone signal err after removal of the above-described filtered downlink audio signal ds and/or internal audio signal ia, that has been filtered by adaptive filter 34A to represent the expected downlink audio delivered to error microphone E, and which is removed from the output of adaptive filter 34A by a combiner 36. SE coefficient control block 33 correlates the actual downlink speech signal ds and/or internal audio signal ia with the components of downlink audio signal ds and/or internal audio signal ia that are present in error microphone signal err. Adaptive filter 34A may thereby be adapted to generate a signal from downlink audio signal ds and/or internal audio signal ia, that when subtracted from error microphone signal err, contains the content of error microphone signal err that is not due to downlink audio signal ds and/or internal audio signal ia.

Also as depicted in FIG. 3, a path of the anti-noise signal may have a programmable gain element 38, such that an increased gain will cause increase of the anti-noise signal combined at output combiner 26 and a decreased gain will cause decrease of the anti-noise signal combined at output combiner 26. As described in greater detail below with respect to FIGS. 4 and 5, the gain of programmable gain element 38 may vary based on a gain signal received from comparison block 42.

For clarity of exposition, the components of audio IC circuit 20 shown in FIGS. 2 and 3 depict components associated with only one audio channel. However, in personal audio devices employing stereo audio (e.g., those with headphones) many components of audio CODEC IC 20 shown in FIGS. 2 and 3 may be duplicated, such that each of two audio channels (e.g., one for a left-side transducer and one for a right-side transducer) are independently capable of performing ANC.

Figure 4:
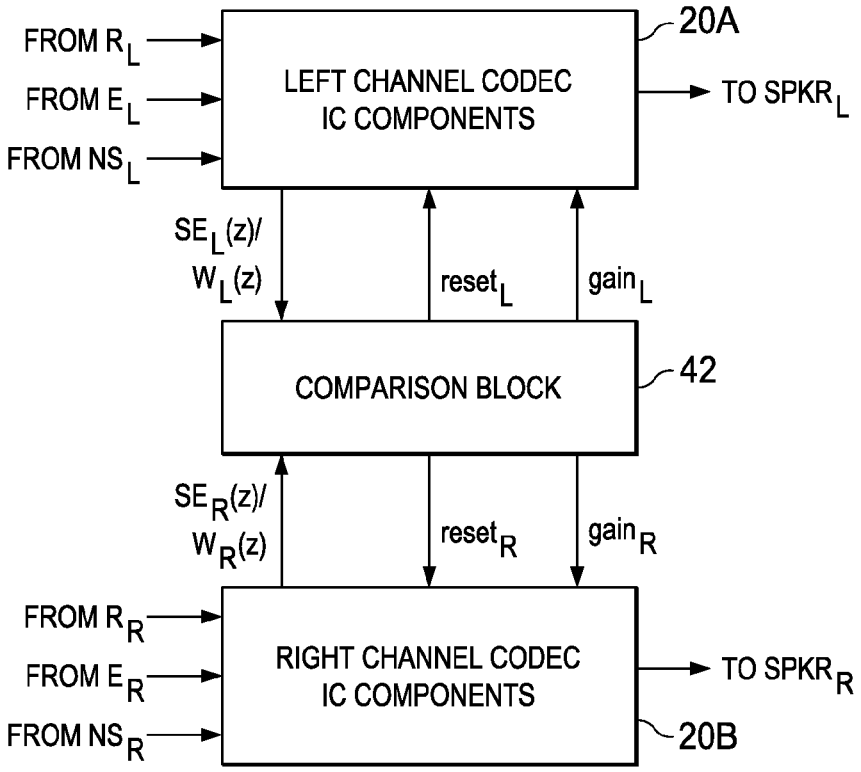
FIG. 4 is a block diagram depicting selected circuits associated with two audio channels within the personal audio device depicted in FIGS. 1A and 1B, in accordance with embodiments of the present disclosure.

Turning to FIG. 4, a system is shown including left channel CODEC IC components 20A, right channel CODEC IC components 20B, and a comparison block 42. Each of left channel CODEC IC components 20A and right channel CODEC IC components 20B may comprise some or all of the various components of CODEC IC 20 depicted in FIG. 2. Thus, based on a respective reference microphone signal (e.g., from reference microphone $R_L$ or $R_R$), a respective error microphone signal (e.g., from error microphone $E_L$ or $E_R$), a respective near-speech microphone signal (e.g., from near-speech microphone $NS_L$ or $NS_R$), and/or other signals, an ANC circuit 30 associated with a respective audio channel may generate an anti-noise signal, which may be combined with a source audio signal and communicated to a respective transducer (e.g., $SPKR_L$ or $SPKR_R$).

Comparison block 42 may be configured to receive from each of left channel CODEC IC components 20A and right channel CODEC IC components 20B a signal indicative of the response SE(z) of the secondary estimate adaptive filter 34A of the channel, shown in FIG. 4 as responses $SE_L(z)$ and $SE_R(z)$, and compare such responses. Comparison of the responses of the secondary estimate adaptive filters 34A may be indicative of a proximity of each of the transducers $SPKR_L$ and $SPKR_R$ to a respective ear of a listener, indicative of a quality of an acoustic seal between each of the transducers $SPKR_L$ and $SPKR_R$ to a respective ear of the listener, and/or indicative of other physical properties of transducers $SPKR_L$ and/or $SPKR_R$. Based on such comparison, comparison block 42 may generate to one or both of left channel CODEC IC components 20A and right channel CODEC IC components 20B a reset signal (e.g., $reset_L$, $reset_R$) and/or a gain signal (e.g., $gain_L$, $gain_R$) in order to alter one or both of the anti-noise signals generated by left channel CODEC IC components 20A and right channel CODEC IC components 20B. In some embodiments, such alteration may be independent of a response of a filter (e.g., adaptive filter 32) generating such anti-noise signal. For example, in such embodiments, a filter (e.g., adaptive filter 32) may generate an anti-noise signal for attempting to reduce presence of ambient audio sounds in an audio output signal at a transducer, wherein such anti-noise signal may be altered (e.g., attenuated) by a gain signal generated by comparison block 42 and communicated to gain element 38. In such embodiments, the adaptive filter 32 generating the anti-signal altered by gain element 38 may be frozen (e.g., prevented from adapting) when the gain of gain element 38 is other than a unity gain, otherwise adaptive filter 32 may attempt to adapt to the attenuated anti-noise signal. To freeze adaptation of the response of adaptive filter 32, adaptive filter 32 or coefficient control block 31 may be configured to cease adaptation when gain of gain element 38 is non-unity (e.g., as shown in FIG. 3, coefficient control block 31 may receive the gain signal from comparison block 42, and may be configured to cease update of coefficients when the gain signal indicates a non-zero gain).

In these and other embodiments, such alteration may include altering a response of the filter (e.g., adaptive filter 32) generating such anti-noise signal. For example, in such embodiments, coefficients of W coefficient control 31 may be reset to an initial value based on a reset signal generated by comparison block 42.

In these and other embodiments, after the anti-noise signal of a particular channel is altered in response to the responses SE(z) of secondary estimate adaptive filters 34A differing by more than a predetermined threshold, the ANC circuit 30 of such channel may reset coefficients of its respective SE coefficient control block 33 to be substantially equal to those of the other SE coefficient control block 33, to provide a starting point for adaptation once the condition (e.g., lack of proximity between transducer and listener's ear) leading to alteration of the anti-noise is remedied.

Although the foregoing discussion contemplates comparison of responses SE(z) of secondary estimate adaptive filters 34A and altering a response of an anti-noise signal in response to the comparison, it should be understood that ANC circuits 30 may compare responses of other elements of ANC circuits 30 and alter anti-noise signals based on such comparisons alternatively or in addition to the comparisons of responses SE(z). For example, in some embodiments, comparison block 42 may be configured to receive from each of left channel CODEC IC components 20A and right channel CODEC IC components 20B a signal indicative of the response W(z) of the adaptive filter 32A of the channel, shown in FIG. 4 as responses $W_L(z)$ and $W_R(z)$, and compare such responses. Comparison of the responses of the adaptive filters 32A may be indicative of a proximity of each of the transducers $SPKR_L$ and $SPKR_R$ to a respective ear of a listener, indicative of a quality of an acoustic seal between each of the transducers $SPKR_L$ and $SPKR_R$ to a respective ear of the listener, and/or indicative of other physical properties of transducers $SPKR_L$ and/or $SPKR_R$. Based on such comparison, comparison block 42 may generate to one or both of left channel CODEC IC components 20A and right channel CODEC IC components 20B a reset signal (e.g., $reset_L$, $reset_R$) and/or a gain signal (e.g., $gain_L$, $gain_R$) in order to alter (e.g., attenuate) one or both of the anti-noise signals generated by left channel CODEC IC components 20A and right channel CODEC IC components 20B.

Figure 5:
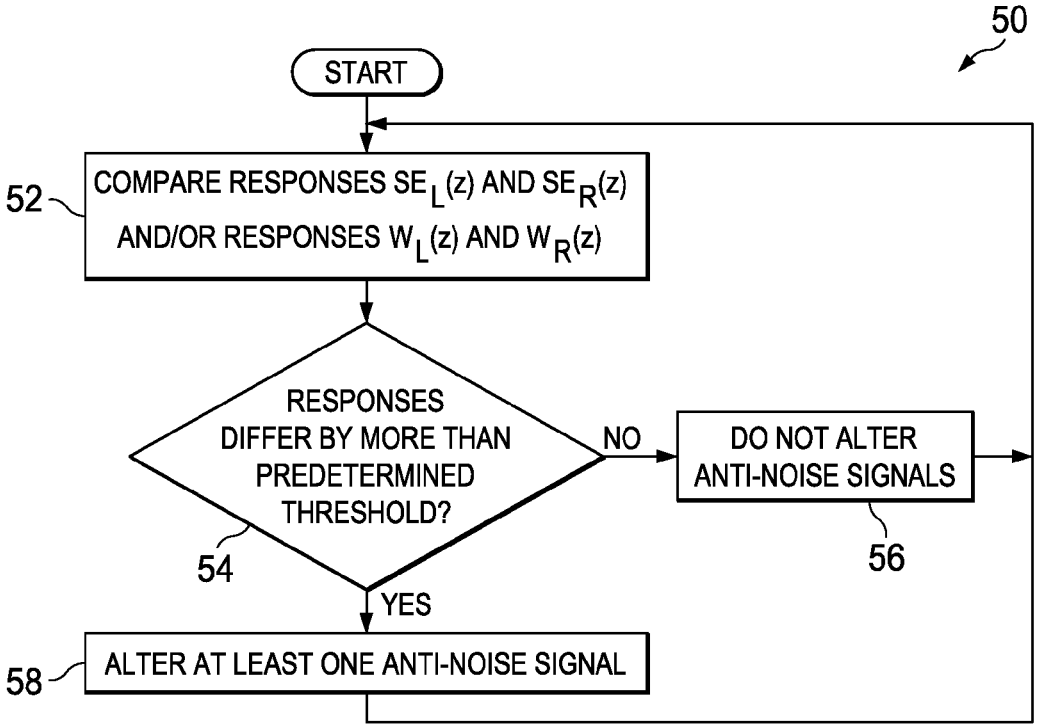
FIG. 5 is a flow chart depicting an example method for controlling generation of anti-noise by an ANC system based on comparison of secondary path information between audio channels of the personal audio device.

FIG. 5 illustrates a flow chart depicting an example method 50 for controlling generation of anti-noise by an ANC system based on comparison of secondary path information between audio channels of the personal audio device. According to one embodiment, method 50 may begin at step 52. As noted above, teachings of the present disclosure may be implemented in a variety of configurations of CODEC IC 20. As such, the preferred initialization point for method 50 and the order of the steps comprising method 50 may depend on the implementation chosen.

At step 52, comparison block 42 or another component of CODEC IC 20 may compare responses $SE_L(z)$ and $SE_R(z)$ of secondary estimate adaptive filters 34A and/or compare responses $W_L(z)$ and $W_R(z)$ of adaptive filters 32. At step 54, comparison block 42 or another component of CODEC IC 20 may determine if the responses $SE_L(z)$ and $SE_R(z)$ differ by more than a predetermined threshold and/or responses $W_L(z)$ and $W_R(z)$ differ by more than the same or another predetermined threshold. If the responses $SE_L(z)$ and $SE_R(z)$ differ by more than a predetermined threshold and/or if responses $W_L(z)$ and $W_R(z)$ differ by more than the same or another predetermined threshold, method 50 may proceed to step 58, otherwise method 50 may proceed to step 56.

At step 56, responsive to a determination that responses $SE_L(z)$ and $SE_R(z)$ do not differ by more than a predetermined threshold and/or that responses $W_L(z)$ and $W_R(z)$ do not differ by more than the same or another predetermined threshold, anti-noise signals generated by each of left channel CODEC IC components 20A and right channel CODEC IC components 20B may be unaltered. After completion of step 56, method 50 may proceed again to step 52.

At step 58, responsive to a determination that responses $SE_L(z)$ and $SE_R(z)$ differ by more than a predetermined threshold and/or that responses $W_L(z)$ and $W_R(z)$ differ by more than the same or another predetermined threshold, anti-noise signals generated by one or both of left channel CODEC IC components 20A and right channel CODEC IC components 20B may be altered. As mentioned above, such alteration may include varying a gain applied to an anti-noise signal in order to attenuate (including muting by attenuating with a zero gain) the anti-noise signal before it is reproduced by a transducer, and/or may include further altering response W(z) of adaptive filter 32 by resetting coefficients of W coefficient control 31 to a predetermined initial value. After completion of step 58, method 50 may proceed again to step 52.

Although FIG. 5 discloses a particular number of steps to be taken with respect to method 50, method 50 may be executed with greater or fewer steps than those depicted in FIG. 5. In addition, although FIG. 5 discloses a certain order of steps to be taken with respect to method 50, the steps comprising method 50 may be completed in any suitable order.

Method 50 may be implemented using comparison block 42 or any other system operable to implement method 50. In certain embodiments, method 50 may be implemented partially or fully in software and/or firmware embodied in computer-readable media.

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

All examples and conditional language recited herein are intended for pedagogical objects to aid the reader in understanding the invention and the concepts contributed by the inventor to furthering the art, and are construed as being without limitation to such specifically recited examples and conditions. Although embodiments of the present inventions have been described in detail, it should be understood that various changes, substitutions, and alterations could be made hereto without departing from the spirit and scope of the disclosure.

What is claimed is:

1. An integrated circuit for implementing at least a portion of a personal audio device, comprising:

a first output for providing a first output signal to a first transducer including both a first source audio signal for playback to a listener and a first anti-noise signal for countering the effect of ambient audio sounds in an acoustic output of the first transducer;

a first error microphone input for receiving a first error microphone signal indicative of the output of the first transducer and the ambient audio sounds at the first transducer;

a second output for providing a second output signal to a second transducer including both a second source audio signal for playback to the listener and a second anti-noise signal for countering the effect of ambient audio sounds in an acoustic output of the second transducer;

a second error microphone input for receiving a second error microphone signal indicative of the output of the second transducer and the ambient audio sounds at the second transducer; and a processing circuit that implements:

a first secondary path estimate adaptive filter for modeling an electro-acoustic path of the first source audio signal through the first transducer and having a response that generates a first secondary path estimate signal from the first source audio signal;

a first coefficient control block that shapes the response of the first secondary path estimate adaptive filter in conformity with the first source audio signal and a first playback corrected error by adapting the response of the first secondary path estimate filter to minimize the first playback corrected error, wherein the first playback corrected error is based on a difference between the first error microphone signal and the first secondary path estimate signal;

a second secondary path estimate adaptive filter for modeling an electro-acoustic path of the second source audio signal through the second transducer and having a response that generates a second secondary path estimate signal from the second source audio signal;

a second coefficient control block that shapes the response of the second secondary path estimate adaptive filter in conformity with the second source audio signal and a second playback corrected error by adapting the response of the second secondary path estimate filter to minimize the second playback corrected error, wherein the second playback corrected error is based on a difference between the second error microphone signal and the second secondary path estimate signal;

a first filter that generates the first anti-noise signal to reduce the presence of the ambient audio sounds at the acoustic output of the first transducer based at least on the first playback corrected error;

a second filter that generates the second anti-noise signal to reduce the presence of the ambient audio sounds at the acoustic output of the second transducer based at least on the second playback corrected error; and a comparison block that compares the response of the first secondary path estimate adaptive filter and the response of the second secondary path estimate adaptive filter.

2. The integrated circuit of claim 1, wherein comparison of the response of the first secondary path estimate adaptive filter and the response of the second secondary path estimate adaptive filter is indicative of a proximity of each of the first transducer and the second transducer to a respective ear of the listener.

3. The integrated circuit of claim 1, wherein comparison of the response of the first secondary path estimate adaptive filter and the response of the second secondary path estimate adaptive filter is indicative of a quality of an acoustic seal between each of the first transducer and the second transducer to a respective ear of the listener.

4. The integrated circuit of claim 1, wherein the processing circuit is configured to alter, responsive to the response of the first secondary path estimate adaptive filter and the response of the second secondary path estimate adaptive filter differing by more than a predetermined threshold, at least one of:

the first anti-noise signal, wherein such alteration is independent of a response of the first filter; and the second anti-noise signal, wherein such alteration is independent of a response of the second filter.

5. The integrated circuit of claim 4, wherein the processing circuit is further configured to, responsive to altering the first-anti-noise signal in response to the response of the first secondary path estimate adaptive filter and the response of the second secondary path estimate adaptive filter differing by more than a predetermined threshold, resetting coefficients of the first coefficient control block to be substantially equal to those of the second coefficient control block.

6. The integrated circuit of claim 4, wherein the processing circuit is configured to attenuate at least one of the first anti-noise signal and the second anti-noise signal responsive to the response of the first secondary path estimate adaptive filter and the response of the second secondary path estimate adaptive filter differing by more than a predetermined threshold.

7. The integrated circuit of claim 6, wherein attenuating at least one of the first anti-noise signal and the second anti-noise signal comprises muting at least one of the first anti-noise signal and the second anti-noise signal.

8. The integrated circuit of claim 6, further comprising:

a first reference microphone input for receiving a first reference microphone signal indicative of the ambient audio sounds at the acoustic output of the first transducer; and a second reference microphone input for receiving a second reference microphone signal indicative of the ambient audio sounds at the acoustic output of the second transducer;

wherein:

the response of the first filter generates the first anti-noise signal from the first reference microphone signal to reduce the presence of the ambient audio sounds at the acoustic output of the first transducer; and the response of the second filter generates the second anti-noise signal from the second reference microphone signal to reduce the presence of the ambient audio sounds at the acoustic output of the second transducer;

a first anti-noise path coefficient control block that shapes the response of the first filter in conformity with the first error microphone signal and the first reference microphone signal by adapting the response of the first filter to minimize the ambient audio sounds in the first error microphone signal;

a second anti-noise path coefficient control block that shapes the response of the second filter in conformity with the second error microphone signal and the second reference microphone signal by adapting the response of the second filter to minimize the ambient audio sounds in the second error microphone signal; and further wherein the processing circuit is configured to:

freeze adaptation of the response of the first filter when the processing circuit attenuates the first anti-noise signal; and freeze adaptation of the response of the second filter when the processing circuit attenuates the second anti-noise signal.

9. The integrated circuit of claim 1, further comprising:

a first reference microphone input for receiving a first reference microphone signal indicative of the ambient audio sounds at the acoustic output of the first transducer; and a second reference microphone input for receiving a second reference microphone signal indicative of the ambient audio sounds at the acoustic output of the second transducer;

wherein:

the response of the first filter generates the first anti-noise signal from the first reference microphone signal to reduce the presence of the ambient audio sounds at the acoustic output of the first transducer; and the response of the second filter generates the second anti-noise signal from the second reference microphone signal to reduce the presence of the ambient audio sounds at the acoustic output of the second transducer;

a first anti-noise path coefficient control block that shapes the response of the first filter in conformity with the first error microphone signal and the first reference microphone signal by adapting the response of the first filter to minimize the ambient audio sounds in the first error microphone signal;

a second anti-noise path coefficient control block that shapes the response of the second filter in conformity with the second error microphone signal and the second reference microphone signal by adapting the response of the second filter to minimize the ambient audio sounds in the second error microphone signal; and further wherein the processing circuit is configured to reset coefficients of at least one of the first anti-noise path coefficient control block and the second anti-noise path coefficient control block to respective initial values responsive to the response of the first secondary path estimate adaptive filter and the response of the second secondary path estimate adaptive filter differing by more than a predetermined threshold.

10. A method for canceling ambient audio sounds in the respective proximities of transducers associated with a personal audio device, the method comprising:

receiving a first error microphone signal indicative of an output of a first transducer and the ambient audio sounds at the first transducer;

receiving a second error microphone signal indicative of an output of a second transducer and the ambient audio sounds at the second transducer;

generating a first secondary path estimate signal from a first source audio signal by filtering the first source audio signal with a first secondary path estimate filter for modeling an electro-acoustic path of the first source audio signal through the first transducer, wherein a response of the first secondary path estimate adaptive filter is shaped in conformity with the first source audio signal and a first playback corrected error by adapting the response of the first secondary path estimate filter to minimize the first playback corrected error, wherein the first playback corrected error is based on a difference between the first error microphone signal and the first secondary path estimate signal;

generating a second secondary path estimate signal from a second source audio signal by filtering the second source audio signal with a second secondary path estimate filter for modeling an electro-acoustic path of the second source audio signal through the second transducer wherein a response of the second secondary path estimate adaptive filter is shaped in conformity with the second source audio signal and a second playback corrected error by adapting the response of the second secondary path estimate filter to minimize the second playback corrected error, wherein the second playback corrected error is based on a difference between the second error microphone signal and the second secondary path estimate signal;

generating a first anti-noise signal to reduce the presence of the ambient audio sounds at the acoustic output of the first transducer based at least on the first playback corrected error;

generating a second anti-noise signal to reduce the presence of the ambient audio sounds at the acoustic output of the second transducer based at least on the second playback corrected error; and comparing the response of the first secondary path estimate adaptive filter and the response of the second secondary path estimate adaptive filter.

11. The method of claim 10, further comprising:

combining the first anti-noise signal with the first source audio signal to generate a first audio signal provided to the first transducer; and combining the second anti-noise signal with the second source audio signal to generate a second audio signal provided to the second transducer.

12. The method of claim 10, wherein comparing the response of the first secondary path estimate adaptive filter and the response of the second secondary path estimate adaptive filter provides an indication of a proximity of each of the first transducer and the second transducer to a respective ear of a listener of the personal audio device.

13. The method of claim 10, wherein comparing the response of the first secondary path estimate adaptive filter and the response of the second secondary path estimate adaptive filter provides an indication of a quality of an acoustic seal between each of the first transducer and the second transducer to a respective ear of the listener.

14. The method of claim 10, further comprising altering, responsive to the response of the first secondary path estimate adaptive filter and the response of the second secondary path estimate adaptive filter differing by more than a predetermined threshold, at least one of:

the first anti-noise signal, wherein such alteration is independent of a response of the first filter; and the second anti-noise signal, wherein such alteration is independent of a response of the second filter.

15. The method of claim 14, further comprising, responsive to altering the first-anti-noise signal in response to the response of the first secondary path estimate adaptive filter and the response of the second secondary path estimate adaptive filter differing by more than a predetermined threshold, resetting coefficients of the first coefficient control block to be substantially equal to those of the second coefficient control block.

16. The method of claim 14, further comprising attenuating at least one of the first anti-noise signal and the second anti-noise signal responsive to the response of the first secondary path estimate adaptive filter and the response of the second secondary path estimate adaptive filter differing by more than a predetermined threshold.

17. The method of claim 16, wherein attenuating at least one of the first anti-noise signal and the second anti-noise signal comprises muting at least one of the first anti-noise signal and the second anti-noise signal.

18. The method of claim 16, further comprising:

receiving a first reference microphone signal indicative of the ambient audio sounds at the acoustic output of the first transducer; and receiving a second reference microphone signal indicative of the ambient audio sounds at the acoustic output of the second transducer;

wherein:

a response of a first filter generates the first anti-noise signal from the first reference microphone signal to reduce the presence of the ambient audio sounds at the acoustic output of the first transducer; and a response of a second filter generates the second anti-noise signal from the second reference microphone signal to reduce the presence of the ambient audio sounds at the acoustic output of the second transducer;

shaping, by a first anti-noise path coefficient control block, the response of the first filter in conformity with the first error microphone signal and the first reference microphone signal by adapting the response of the first filter to minimize the ambient audio sounds in the first error microphone signal, wherein adaptation of the response of the first filter is frozen during attenuation of the first anti-noise signal; and shaping, by a second anti-noise path coefficient control block, the response of the second filter in conformity with the second error microphone signal and the second reference microphone signal by adapting the response of the second filter to minimize the ambient audio sounds in the second error microphone signal, wherein adaptation of the response of the second filter is frozen during attenuation of the second anti-noise signal.

19. The method of claim 10, further comprising:

receiving a first reference microphone signal indicative of the ambient audio sounds at the acoustic output of the first transducer; and receiving a second reference microphone signal indicative of the ambient audio sounds at the acoustic output of the second transducer;

wherein:

a response of a first filter generates the first anti-noise signal from the first reference microphone signal to reduce the presence of the ambient audio sounds at the acoustic output of the first transducer; and a response of a second filter generates the second anti-noise signal from the second reference microphone signal to reduce the presence of the ambient audio sounds at the acoustic output of the second transducer;

shaping, by a first anti-noise path coefficient control block, the response of the first filter in conformity with the first error microphone signal and the first reference microphone signal by adapting the response of the first filter to minimize the ambient audio sounds in the first error microphone signal;

shaping, by a second anti-noise path coefficient control block, the response of the second filter in conformity with the second error microphone signal and the second reference microphone signal by adapting the response of the second filter to minimize the ambient audio sounds in the second error microphone signal; and resetting coefficients of at least one of the first anti-noise path coefficient control block and the anti-noise path second coefficient control block to respective initial values responsive to the response of the first secondary path estimate adaptive filter and the response of the second secondary path estimate adaptive filter differing by more than a predetermined threshold.

20. An integrated circuit for implementing at least a portion of a personal audio device, comprising:

a first output for providing a first output signal to a first transducer including both a first source audio signal for playback to a listener and a first anti-noise signal for countering the effect of ambient audio sounds in an acoustic output of the first transducer;

a first error microphone input for receiving a first error microphone signal indicative of the output of the first transducer and the ambient audio sounds at the first transducer;

a first reference microphone input for receiving a first reference microphone signal indicative of the ambient audio sounds at the acoustic output of the first transducer; and a second output for providing a second output signal to a second transducer including both a second source audio signal for playback to the listener and a second anti-noise signal for countering the effect of ambient audio sounds in an acoustic output of the second transducer;

a second error microphone input for receiving a second error microphone signal indicative of the output of the second transducer and the ambient audio sounds at the second transducer;

a second reference microphone input for receiving a second reference microphone signal indicative of the ambient audio sounds at the acoustic output of the second transducer; and a processing circuit that implements:

a first adaptive filter that generates the first anti-noise signal from the first reference microphone signal to reduce the presence of the ambient audio sounds at the acoustic output of the first transducer;

a second adaptive filter that generates the second anti-noise signal from the second reference microphone signal to reduce the presence of the ambient audio sounds at the acoustic output of the second transducer;

a first coefficient control block that shapes the response of the first adaptive filter in conformity with the first error microphone signal and the first reference microphone signal by adapting the response of the first adaptive filter to minimize the ambient audio sounds in the first error microphone signal;

a second coefficient control block that shapes the response of the second adaptive filter in conformity with the second error microphone signal and the second reference microphone signal by adapting the response of the second adaptive filter to minimize the ambient audio sounds in the second error microphone signal; and a comparison block that compares the response of the first adaptive filter and the response of the second adaptive filter.

21. The integrated circuit of claim 20, wherein the processing circuit is configured to alter, responsive to the response of the first adaptive filter and the response of the second adaptive filter differing by more than a predetermined threshold, at least one of:

the first anti-noise signal, wherein such alteration is independent of a response of the first adaptive filter; and the second anti-noise signal, wherein such alteration is independent of a response of the second adaptive filter.

22. A method for canceling ambient audio sounds in the respective proximities of transducers associated with a personal audio device, the method comprising:

receiving a first error microphone signal indicative of an output of a first transducer and the ambient audio sounds at the first transducer;

receiving a second error microphone signal indicative of an output of a second transducer and the ambient audio sounds at the second transducer;

receiving a first reference microphone signal indicative of the ambient audio sounds at the acoustic output of the first transducer;

receiving a second reference microphone signal indicative of the ambient audio sounds at the acoustic output of the second transducer;

generating, by a first adaptive filter, a first anti-noise signal from the first reference microphone signal to reduce the presence of the ambient audio sounds at the acoustic output of the first transducer;

generating, by a second adaptive filter, a second anti-noise signal from the second reference microphone signal to reduce the presence of the ambient audio sounds at the acoustic output of the second transducer;

shaping, by a first anti-noise path coefficient control block, a response of the first filter in conformity with the first error microphone signal and the first reference microphone signal by adapting the response of the first filter to minimize the ambient audio sounds in the first error microphone signal;

shaping, by a second anti-noise path coefficient control block, a response of the second filter in conformity with the second error microphone signal and the second reference microphone signal by adapting the response of the second filter to minimize the ambient audio sounds in the second error microphone signal; and comparing the response of the first adaptive filter and the response of the second adaptive filter.

23. The method of claim 22, further comprising altering, responsive to the response of the first adaptive filter and the response of the second adaptive filter differing by more than a predetermined threshold, at least one of:

the first anti-noise signal, wherein such alteration is independent of a response of the first adaptive filter; and the second anti-noise signal, wherein such alteration is independent of a response of the second adaptive filter.

* * * * *